US005848163A

United States Patent [19]

Gopalakrishnan et al.

[11] Patent Number: 5,848,163

[45] Date of Patent: Dec. 8, 1998

[54] METHOD AND APPARATUS FOR SUPPRESSING BACKGROUND MUSIC OR NOISE FROM THE SPEECH INPUT OF A SPEECH RECOGNIZER

[75] Inventors: Ponani Gopalakrishnan, Yorktown Heights; David Nahamoo, White Plains; Mukund Panmanabhan, Ossining; Lazaros Polymenakos, White Plains, all of N.Y.

[73] Assignee: International Business Machines Corporation, Armonk, N.Y.

[21] Appl. No.: 594,679

[22] Filed: Feb. 2, 1996

[51] Int. Cl.[6] ..... H04R 29/00

[52] U.S. Cl. ..... 381/56; 381/66; 381/94; 395/2.25; 395/2.26; 395/2.27

[58] Field of Search ..... 395/2.35, 2.36, 395/2.19, 2.24, 2.42, 2.25–2.27; 381/56, 94, 66; 379/388–390, 410–412

[56] References Cited

U.S. PATENT DOCUMENTS

| | | | |
|---|---|---|---|
| 4,658,426 | 4/1987 | Chabries et al. | 381/94 |
| 4,829,574 | 5/1989 | Dewhurst et al. | 381/41 |
| 4,852,181 | 7/1989 | Morito et al. | 381/46 |
| 4,956,867 | 9/1990 | Zurek et al. | 381/94 |
| 5,241,692 | 8/1993 | Harrison et al. . | |
| 5,305,420 | 4/1994 | Nakamura et al. | 395/2.8 |
| 5,568,558 | 10/1996 | Ramm et al. | 381/94 |
| 5,590,206 | 12/1996 | An et al. | 381/94 |

*Primary Examiner*—Curtis Kuntz
*Assistant Examiner*—Duc Nguyen

[57] ABSTRACT

A method and apparatus for removing the effect of background music or noise from speech input to a speech recognizer so as to improve recognition accuracy has been devised. Samples of pure music or noise related to the background music or noise that corrupts the speech input are utilized to reduce the effect of the background in speech recognition. The pure music and noise samples can be obtained in a variety of ways. The music or noise corrupted speech input is segmented in overlapping segments and is then processed in two phases: first, the best matching pure music or noise segment is aligned with each speech segment; then a linear filter is built for each segment to remove the effect of background music or noise from the speech input and the overlapping segments are averaged to improve the signal to noise ratio. The resulting acoustic output can then be fed to a speech recognizer.

17 Claims, 3 Drawing Sheets

METHOD AND APPARATUS FOR SUPPRESSING BACKGROUND MUSIC OR NOISE FROM THE SPEECH INPUT OF A SPEECH RECOGNIZER

The invention was developed under US Government Contract number 33690098 "Robust Context Dependent Models and Features for Continuous Speech Recognition". The US Government has certain rights to the invention.

FIELD OF THE INVENTION

The invention relates to the recognition of speech signals corrupted with background music and/or noise.

BACKGROUND AND SUMMARY OF THE INVENTION

Speech recognition is an important aspect of furthering man-machine interaction. The end goal in developing speech recognition systems is to replace the keyboard interface to computers with voice input. This may make computers more user friendly and enable them to provide broader services to users. To this end, several systems have been developed. However, the effort for the development of these systems typically concentrates on improving the transcription error rate on relatively clean data obtained in a controlled and steady-state environment, i.e., where a speaker is speaking relatively clearly in a quiet environment. Though this may be a reasonable assumption for certain applications such as transcribing dictation, there are several real-world situations where the ambient conditions are noisy or rapidly changing or both. Since the goal of research in speech recognition is the universal use of speech-recognition systems in real-world situations (for e.g., information kiosks, transcription of broadcast shows, etc.), it is necessary to develop speech-recognition systems that operate under these non-ideal conditions. For instance, in the case of broadcast shows, segments of speech from the anchor and the correspondents (which are either relatively clean, or have music playing in the background) are interspersed with music and interviews with people (possibly over a telephone, and possibly under noisy conditions). It is important, therefore, that the effect of the noisy and rapidly changing environment is studied and that ways to cope with the changes are devised.

The invention presented herein is a method and apparatus for suppressing the effect of background music or noise in the speech input to a speech recognizer. The invention relates to adaptive interference canceling. One known method for estimating a signal that has been corrupted by additive noise is to pass it through a linear filter that will suppress noise without changing the signal substantially. Filters that can perform this task can be fixed or adaptive. Fixed filters require a substantial amount of prior knowledge about both the signal and noise.

By contrast, an adaptive filter in accordance with the invention can adjust its parameters automatically with little or no prior knowledge of the signal or noise. The filtering and subtraction of noise are controlled by an appropriate adaptive process without distorting the signal or introducing additional noise. Widrow et al in their December 1975, Proceedings IEEE paper "Adaptive Noise Cancelling: Principles and applications" introduced the ideas and the theoretical background that leads to interference canceling. The technique has found a wide variety of applications for the removal of noise from signals; a very well known application is echo canceling in telephony.

The basic concept of noise-canceling is shown in FIG. 1. A signal s and an uncorrelated noise $n_0$ are received at a sensor. The noise corrupted signal $s+n_0$ is the input to the noise canceler. A second sensor receives a noise $n_1$ which is uncorrelated with the signal s but correlated in some way to the noise $n_0$. The noise signal $n_1$ (reference signal) is filtered appropriately to produce a signal y as close to $n_0$ as possible. This output y is subtracted from the input $s+n_0$ to produce the output of the noise canceler $s+n_0-y$.

The adaptive filtering procedure can be viewed as trying to find the system output $s+n_0-y$ that differs minimally from the signal s in the least squares sense. This objective is accomplished by feeding the system output back to the adaptive filter and adjusting its parameters through an adaptive algorithm (e.g. the Least Mean Square (LMS) algorithm) in order to minimize the total system output power. In particular, the output power can be written $E[(s+n_0-y)^2]=E[s^2]+E[(n_0-y)^2]+2E[s\,(n_0-y)]$. The basic assumption made is that s is uncorrelated with $n_0$ and with y. Thus the minimum output power criterion is $E_{min}[(s+n_0-y)^2]=E[s^2]+E_{min}[(n_0-y)^2]$. We observe that when $E[(n_0-y)^2]$ is minimized, the output signal $s+n_0-y$ matches the signal s optimally in the least squares sense. Furthermore, minimizing the total output power minimizes the output noise power and thus maximizes the output signal-to-noise-ratio. Finally, if the reference input $n_1$ is uncorrelated completely with the input signal $s+n_0$ then the filter will give zero output and will not increase the output noise. Thus the adaptive filter described is the desired solution to the problem of noise cancellation.

The existing noise canceling method that we described relies heavily on the assumption that the noise is uncorrelated with the signal s. Usually it requires that we get the reference signal synchronously with the input signal and from an independent source (sensor), so that the noise signal no and the reference signal $n_1$ are correlated. The existing noise canceling method does not apply to the case where the reference noise or music signal are obtained asynchronously from the speech signal because then the reference signal may be almost uncorrelated with the noise or music that corrupted the speech signal. This is particularly true for musical signals where the correlation of a part of a musical piece with a different part of the same musical piece may be very small.

It is an object of this invention to provide a method and an apparatus for finding optimum or near optimum suppression of the music or noise background of a speech signal without introducing additional interference to the speech input in order to improve the speech recognition accuracy.

It is another object of the invention to provide such an interference cancellation method that will apply in all the situations where the reference noise or music is obtained either synchronously or asynchronously with the speech signal, without prior knowledge of how closely related it is to the actual background music that has corrupted the speech signal.

DETAILED DESCRIPTION OF THE INVENTION

Figure 1:
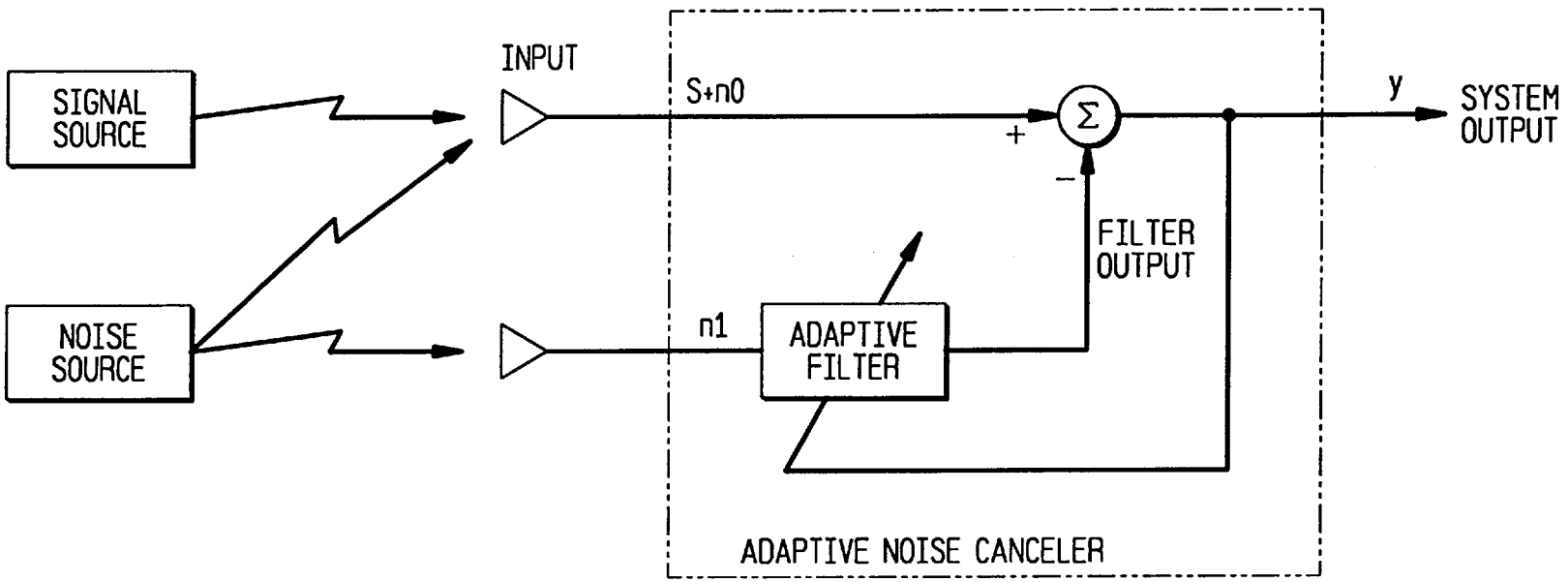
FIG. 1 (PRIOR ART)
FIG. 1 is a block diagram of an adaptive noise cancelling system.

The invention is a method and apparatus for finding the part of the music or noise reference signal that best matches to the actual music or noise that has corrupted the speech signal and then removing it optimally without introducing additional noise. We have a reference music or noise signal $n_1$ of duration $T_1$ and an input signal $x=s+n_0$ of duration $T_2$, where s is the pure speech and $n_0$ is the corrupting background noise or music.

According to the invention, the music or noise reference is segmented to overlapping parts of smaller duration t. Assume there are $m_1$ such segments which we will denote as $n_{1(k)}$ where $k\epsilon\{1, \ldots, m_1\}$. This process can be visualized as follows: We have a time window t which slides over the duration $T_1$ of the reference signal; we obtain segments of the reference signal at $$\frac{T_1 - r}{m_1}$$

time intervals.

The input signal is similarly segmented in overlapping parts of duration t. Assume there are $m_2$ such segments which we will denote as x(1) where $1\epsilon\{1, \ldots, m_2\}$. In this case, the time window t slides over the duration $T_2$ of the reference signal and we obtain segments of the reference signal at $$\frac{T_2 - r}{m_2}$$

time intervals. The way the reference signal segments overlap may be different from the way the input signal segments overlap since $$\frac{T_1 - r}{m_1}$$

may be different from $$\frac{T_2 - r}{m_2}.$$

Next, for each input signal segment x(1) we find a corresponding reference signal segment $n_1(k_1)$ for which the optimal one-tap filter, according to the minimum power criterion, results to the minimum power of the output signal. In particular, we find $$K_1 = arg\, K\epsilon \left( \min_{l, \ldots m_i} \right) \left( \min_{\alpha} E\left[((x(l) - \alpha n_1(K))^2\right) \right)$$

In one aspect of the invention the result can be obtained by using the Weiner closed form solution for the one tap filter:

$$\alpha\min = \frac{E[x(l)' - n_1(l)]}{E[m_1(k)^2]}$$

where the numerator is the cross-correlation of the input signal segment and the reference signal segment while the denominator is the average energy of the reference signal segment. In another aspect of the invention, the result can be obtained iteratively by the LMS algorithm. Thus the reference signal segment that best matches the background of the input segment is identified.

According to our invention, after each input signal segment has been associated with the best matching reference segment, the effect of the background noise or music can be suppressed. In particular, for each input signal segment x(1) we build a filter of the size of our choice to subtract optimally, according to the minimum power criterion, its associated reference signal segment $n_1(k_1)$. As in the case of the one tap filter this operation can be performed either by using the Weiner closed form solution or iteratively by the LMS algorithm. The difference is that the calculation will be more involved since now we have to estimate many filter coefficients. As a result of this operation we obtain overlapping output signal segments y(1) of duration t, where $1\epsilon\{1, \ldots, m_2\}$.

From the overlapping output signal segments y(1) we obtain the output signal y by averaging the signal segments y(1) over the periods of overlap. The resulting output signal y is then fed to the speech recognizer.

In one aspect of the invention, the reference signal is obtained from the recorded session of speech in background noise or music: the pure music or noise part of the recording preceding or following the part where there is actual speech is used as reference signal.

In another aspect of the invention, we have a recorded library of pure music or noise which includes an identical or similar piece to the background interference of the input signal. Similarly, the pure interference may be recorded separately if there is such a channel available: for example if the musical piece or the source of noise are known it may be recorded simultaneously but separately from the speech input.

The method and apparatus that we have described can be used either for continuous signals or for sampled signals. In the case of sampled signals, it is preferable that the reference signal and the input signal are sampled at the same rate and in synchronization. For example, this requirement can be easily satisfied if the reference signal is obtained from the same recording as the input signal. However, the method can still be used without the need for the same sampling rate or synchronization, by sampling one of the signals (the reference or the input) at a very high sampling rate so as to have relevant samples with the sampled corrupting interference and by sub-sampling it appropriately to match their sampling rates and make the two signals as close to synchronous as possible. Finally, if a signal sampled at a higher sampling rate is not available, the invention can still be used to provide some suppression of the background interference.

In a further aspect of the invention, the reference signal can be obtained by passing the input signal through a speech recognizer that has been trained with speech in music or noise background. Segments that are marked in the output of the recognizer as silence correspond to pure music or pure noise, and they can be used as reference signals.

In the method and apparatus according to the present invention, the choice of the overlapping reference and input segments and the averaging for the construction of the output signal can be fine-tuned so as to both find better matching reference signal segments and minimize the introduction of noise in the signal. In particular, smaller segments result in better suppression of the background but may have higher correlation with the pure speech signal, thus resulting in the introduction of noise. The overlapping and averaging of the segments helps prevent the introduction of noise by improving the SNR of the output signal. The choices depend on the particular application.

The invention also relates to a method and apparatus for automatically recognizing a spoken utterance. In particular, the automatic recognizer may be trained with music or noise corrupted speech segments after the suppression of the background interference.

Another aspect of the invention is that the computation is done efficiently in a two stage process: first the best matching reference segment is obtained with a simple one tap filter which is easy and fast to calculate. Then the actual background suppression is performed with a larger filter. Thus computational time is not wasted making large filters for reference segments that do not match well. Furthermore, the search for the best matching reference segment can either be exhaustive or selective. In particular, all possible t duration segments of the reference signal may be used, or we may have an upper bound on the number of segments that overlap. We may also vary the duration t of the segments starting with a large value for t to make a coarse first estimate which we may then reduce to get better estimates when needed.

The method and apparatus according to the invention are advantageous because they can suppress the effect of the background and improve the accuracy of the automatic speech recognizer. Furthermore, they are computationally efficient and can be used on a wide variety of situations.

Figure 2:
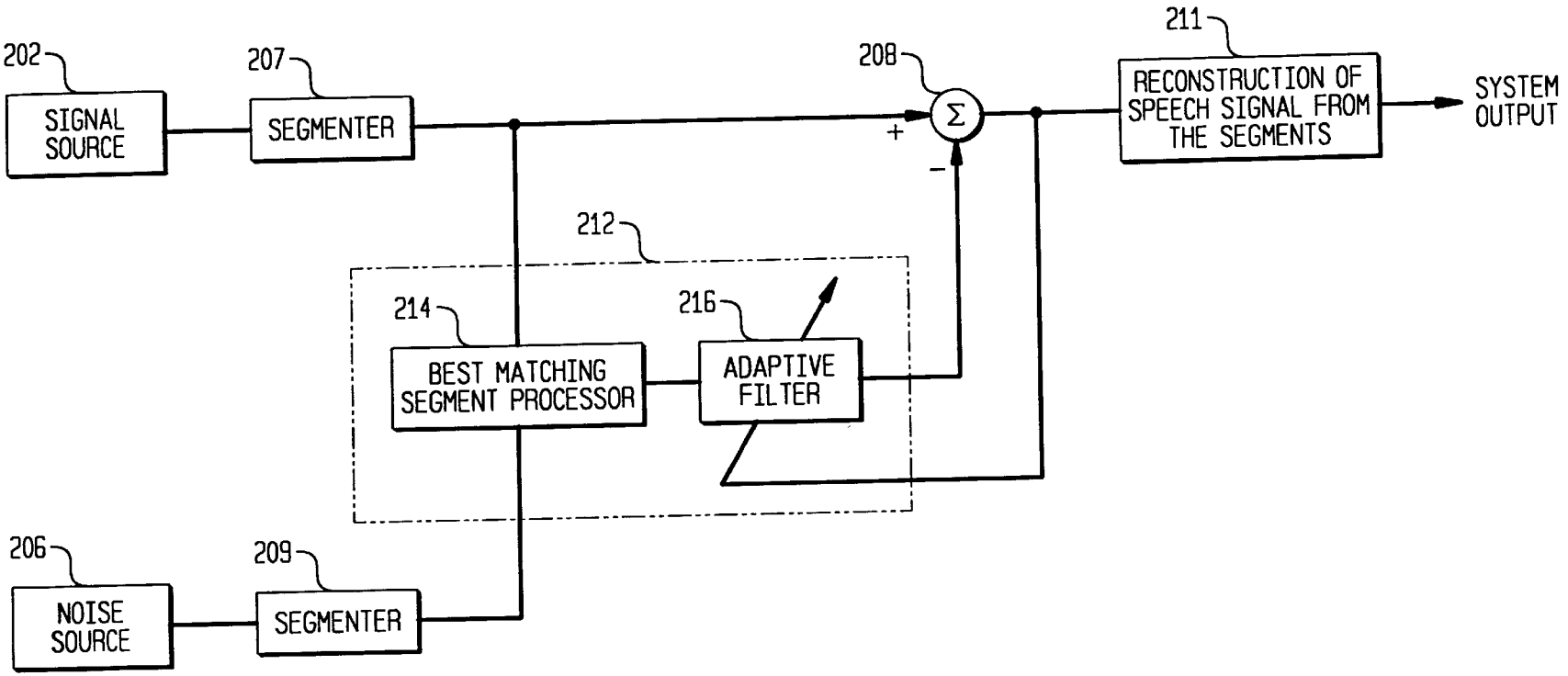
FIG. 2 is a block diagram of a system in accordance with the invention.

FIG. 2 is a block diagram of a system in accordance with the invention. The invention can be implemented on a general purpose computer programmed to carry out the functions of the components of FIG. 2 and described elsewhere herein. The system includes a signal source 202, which can be for instance, the digitized speech of a human speaker, plus background noise. A digitized representation of the background noise will be provided by noise source 206. The source of the noise can be, for instance, any music source. The digitized representations of the speech+noise and the noise are segmented in accordance with known techniques and applied to a best matching segment processor 214, which makes up a portion of an adaptive filter 212. In the best matching segment processor, the segmented noise is compared with the noise-corrupted speech to determine the best match between the noise segments and the noise that has corrupted the speech. The best matching segment that is output from processor 214 is then filtered in filter 216 in the manner described above and provided as a second input to summing circuit 208, where it is subtracted from the output of segmenter 207, and an uncorrupted speech signal is reconstructed from these segments at block 211.

Figure 3:
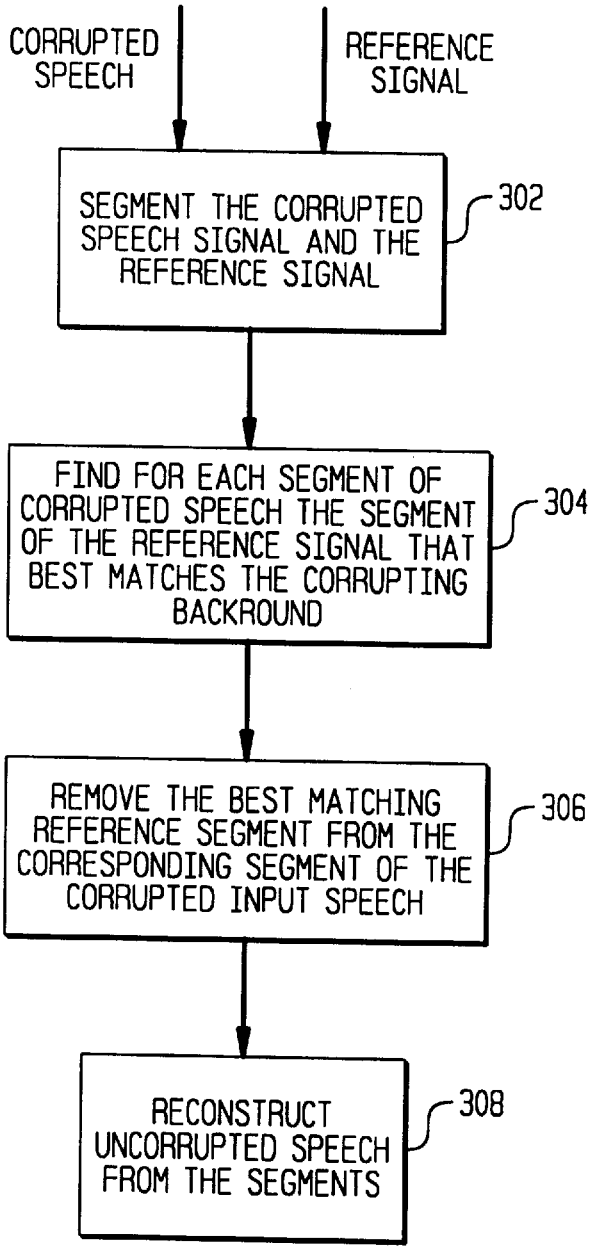
FIG. 3 is a flow diagram describing one embodiment of the method of the present invention.

FIG. 3 is a flow diagram of the method of the present invention, which can be implemented on an appropriately programmed general purpose computer. The method begins by providing a corrupted speech signal and a reference signal representing the signal corrupting the speech signal. At block 302, the corrupted speech signal and the reference signal are segmented in the manner described herein. The step at block 304 finds, for each segment of corrupted speech, the segment of the reference signal that best matches the corrupting features of the corrupted speech signal.

The step at block 306 removes the best matching signal from the corresponding segment of the corrupted input speech signal. An uncorrupted speech signal is then reconstructed using the filtered segments.

While the invention has been described in particular with respect to preferred embodiments thereof, it will be understood that modifications to these embodiments can be effected without departing from the spirit and scope of the invention.

We claim:

1. A method for suppression of an unwanted feature from a string of input speech, comprising:

a) providing a string of speech containing the unwanted feature, referred to as corrupted input speech;

b) providing a reference signal representing the unwanted feature;

c) segmenting the corrupt input speech and the reference signal, respectively, into predetermined time segments;

d) finding for each time segment of the speech having the unwanted feature the time segment of the reference signal that best matches the unwanted feature;

e) removing the best matching time segment of the reference signal from the corresponding time segment of the corrupted input speech;

f) outputting a signal representing the speech with the unwanted features removed;

wherein the step of providing a reference signal representing the unwanted feature comprises passing speech containing unwanted features through a speech recover trained to recognize noise or music corrupted speech, the speech recognizer producing intervalled outputs corresponding to either the presence or non-presence of speech, wherein intervals marked as silence by the specially trained speech recognizer are pure music or pure noise and using the segments identified as having music or noise as the reference signals.

2. A method for suppression of an unwanted feature from a string of input speech, comprising:

a) providing a string of speech containing the unwanted feature, referred to as corrupted input speech;

b) providing a reference signal representing the unwanted feature;

c) segmenting the corrupted input speech and the reference signal, respectively, into predetermined time segments;

d) finding for each time segment of the speech having the unwanted feature the time segment of the reference signal that best latches the unwanted feature;

e) removing the best matching time segment of the reference signal from the corresponding time segment of the corrupted input speech;

f) outputting a signal representing the speech with the unwanted features removed;

wherein step (d) is performed utilizing a first filter to find the time segment of the reference signal that best matches the unwanted feature and step (e) is performed utilizing a second filter to remove the best matching time segment of the reference signal from the corresponding time segment of the corrupted input speech.

3. The method of claim 2, wherein the unwanted feature can include music, noise or both.

4. The method of claim 2, wherein the step of segmenting comprises:

determining a desired time segment size and segmenting the speech into overlapping segments of the desired time segment size.

5. The method of claim 4, wherein the time segments overlap by about 15/16 of the duration of each time segment.

6. The method of claim 4, wherein the preferred time segment size is between about 8 and 32 milliseconds.

7. The method of claim 2, further comprising determining a desired time segment size and segmenting the corrupted input speech and the reference signal, respectively, into non-overlapping time segments of that size.

8. The method of claim 2, wherein step d) comprises determining a size of a filter for performing said step; and finding a best-matched filter of that size.

9. The method of claim 8, wherein the step of finding a best-matched filter is performed in one step using a closed form solution.

10. The method of claim 8, wherein the step of finding a best-matched filter is performed by iteratively applying the least mean square algorithm.

11. The method of claim 2, wherein the step of finding for each time segment of corrupted input speech, the time segment of the reference signal that best matches the unwanted features, comprises:

selecting a best size for a match filter;

computing the best matched filter coefficients; and in the case of overlap, after subtracting the filtered reference signal, reconstructing an output speech string by averaging the overlapping filtered segments.

12. The method of claim 9, wherein the step of removing the best matching time segment of the reference signal from the corresponding time segment of the corrupted input speech comprises:

filtering the reference segment from the corresponding speech segment using the best match filter.

13. The method of claim 2, wherein the step of providing a reference signal representing the unwanted feature comprises selecting the reference signal from an existing library of unwanted features.

14. The method of claim 2, wherein the step of providing a reference signal representing the unwanted feature comprises using a pure corrupting signal occurring prior to or following the corrupted speech input.

15. The method of claim 2, wherein the reference signal is provided synchronously and independently of the speech signal with the unwanted feature, and the reference signal corresponds to the actual unwanted feature.

16. The method of claim 2, further comprising feeding the output to a speech recognition system.

17. A system for suppression of an unwanted feature from a string of input speech, comprising:

a) means for providing a string of speech containing the unwanted feature, referred to as corrupted input speech;

b) means for providing a reference signal representing the unwanted feature;

c) means for segmenting the corrupted input speech and the reference signal, respectively, into predetermined time segments;

d) means for finding for each time segment of speech containing the unwanted feature the time segment of the reference signal that best matches the unwanted feature;

e) means for removing the best matching time segment of the reference signal from the corresponding time segment of the corrupted input speech;

f) means for outputting a signal representing the speech with the unwanted feature removed;

wherein the finding means includes a first filter for finding the time segment of the reference signal that best matches the unwanted feature and the removing means includes a second filter for removing the best matching time segment of the reference signal from the corresponding time segment of the corrupted input speech.

* * * * *